US011828563B1

(12) United States Patent
Pineda

(10) Patent No.: US 11,828,563 B1
(45) Date of Patent: Nov. 28, 2023

(54) HOPPER WITH REMOVABLE CAMERA

(71) Applicant: HK Army Inc., Signal Hill, CA (US)

(72) Inventor: Jason Jeremiah Pineda, Signal Hill, CA (US)

(73) Assignee: HK Army Inc., Signal Hill, CA (US)

( * ) Notice: Subject to any disclaimer, the term of this patent is extended or adjusted under 35 U.S.C. 154(b) by 0 days.

(21) Appl. No.: 18/354,273

(22) Filed: Jul. 18, 2023

(51) Int. Cl.
*F41B 11/70* (2013.01)
*G03B 29/00* (2021.01)
*F41B 11/52* (2013.01)
*F41B 11/71* (2013.01)

(52) U.S. Cl.
CPC ..... *F41B 11/52* (2013.01); *F41B 11/71* (2013.01)

(58) Field of Classification Search
CPC ..... F41B 11/52; F41B 11/53; F41B 11/57; F41B 11/70; F41B 11/71; G03B 29/00
USPC ..... 124/1, 49; 396/419, 426
See application file for complete search history.

(56) References Cited

U.S. PATENT DOCUMENTS 5,282,454 A * 2/1994 Bell ..... F41B 11/53 221/21
5,736,720 A * 4/1998 Bell ..... F41B 11/53 273/DIG. 26
5,816,232 A * 10/1998 Bell ..... F41B 11/53 221/277
6,415,781 B1 * 7/2002 Perrone ..... F41B 11/57 124/49
6,418,919 B1 * 7/2002 Perrone ..... F41B 11/57 221/200
6,481,432 B2 * 11/2002 Rushton ..... F41B 11/53 124/49
6,488,019 B2 * 12/2002 Kotsiopoulos ..... F41B 11/71 89/33.17
6,590,386 B1 * 7/2003 Williams ..... F41A 19/01 124/71
6,779,518 B2 * 8/2004 Dobbins ..... F41A 35/00 124/71
6,941,693 B2 * 9/2005 Rice ..... F41A 19/67 89/129.02
7,604,420 B2 * 10/2009 Moody ..... G03B 17/561 396/419
7,654,255 B2 * 2/2010 Spicer ..... F41B 11/53 124/49
7,779,825 B2 * 8/2010 Estrate ..... F41B 11/53 124/51.1

(Continued)

FOREIGN PATENT DOCUMENTS

TW M241630 U 8/2004

*Primary Examiner* — Alexander R Niconovich
(74) *Attorney, Agent, or Firm* — Knobbe Martens Olson & Bear LLP

(57) ABSTRACT

A paintball hopper for a paintball gun with one or more removable cameras. The hopper can include a housing with one or more windows. The one or more removable cameras can be inserted into an inner volume of the housing so the one or more removable cameras are positioned to capture image data through the one or more windows. The one or more windows can be removably coupled to the housing so the windows can be replaced if the one or more windows are dirty or damaged. In some embodiments, the one or more removable cameras can be coupled to an outer surface of the housing. The housing can include a display configured to display image data from the one or more removable cameras.

20 Claims, 16 Drawing Sheets

(56) References Cited

U.S. PATENT DOCUMENTS

| | | | | |
|---|---|---|---|---|
| 7,841,328 | B2 * | 11/2010 | Italia | F41B 11/57 124/51.1 |
| 7,880,793 | B2 | 2/2011 | Holmberg | |
| 7,921,835 | B2 * | 4/2011 | Campo | F41B 11/53 124/51.1 |
| 8,210,159 | B1 * | 7/2012 | Neumaster | F41B 11/53 221/13 |
| 8,312,870 | B2 * | 11/2012 | Higgins | F41B 11/57 42/2 |
| 8,360,042 | B2 * | 1/2013 | Skilling | F41B 11/70 124/71 |
| 8,578,920 | B2 * | 11/2013 | Estrate | H04N 7/183 124/51.1 |
| 8,657,509 | B2 * | 2/2014 | Galik | F16M 13/022 396/428 |
| 9,109,853 | B2 * | 8/2015 | Higgins | F41A 19/69 |
| 9,322,616 | B2 * | 4/2016 | Craven | F41G 3/165 |
| 2004/0119816 | A1 * | 6/2004 | Swain | H04N 23/50 348/E5.025 |
| 2005/0066950 | A1 * | 3/2005 | Yu | F41B 11/71 124/45 |
| 2008/0236558 | A1 * | 10/2008 | Bosch | F41B 11/57 124/48 |
| 2010/0231375 | A1 * | 9/2010 | Newman | F41B 11/57 124/56 |
| 2013/0188053 | A1 * | 7/2013 | Slevin | F41G 11/003 348/158 |
| 2014/0069406 | A1 * | 3/2014 | Hastings | F41B 11/52 124/80 |

* cited by examiner

HOPPER WITH REMOVABLE CAMERA

BACKGROUND

Field

The present disclosure is directed to a hopper for a paintball gun, and more particularly to a hopper that can removably couple to a camera.

Description

Paintball is a fast-paced and competitive sport in which players use air-powered guns to fire paintballs at each other. Players like to record footage of matches from a first-person view. In competitive matches, player may want to capture footage of a match so the player can review the footage later to analyze strategies, identifying areas for improvement, and refine tactical decisions. Some competitive matches may be broadcast on television or the internet, and the broadcaster may want to capture a first-person view of each player in the match. In casual matches, players may want to capture footage from a first-person view so they can share their match with teammates or friends. Players may also want to capture footage from a first-person view to create online content such as tutorials, vlogs, or other video content. Players may attach cameras to their torso to capture footage. However, when the camera is attached to a player's torso, the paintball gun may block the camera. Therefore, some players attach camera to their headgear. However, when attempting to hide behind cover, the camera might protrude out from behind the cover exposing the player's location to players on opposing teams.

SUMMARY

For purposes of this summary, certain aspects, advantages, and novel features are described herein. It is to be understood that not necessarily all such advantages may be achieved in accordance with any particular embodiment. Thus, for example, those skilled in the art will recognize the disclosures herein may be embodied or carried out in a manner that achieves one or more advantages taught herein without necessarily achieving other advantages as may be taught or suggested herein.

In accordance with one aspect of the disclosure, a hopper for a paintball gun removably couples to a camera to allow players to be able to capture footage of matches without the camera being blocked by their paintball gun or affecting how the player plays matches.

In accordance with one aspect of the disclosure, a paintball hopper for a paintball gun, includes a housing. The housing includes a window. The housing forms an inner volume. The housing is configured to removably couple to a camera inside the inner volume so the camera is removably positioned inside the inner volume and configured to capture images through the window.

In accordance with one aspect of the disclosure, the window is coupled to a front end of the housing.

In accordance with one aspect of the disclosure, the window is removably coupled to the housing.

In accordance with one aspect of the disclosure, the hopper includes a hopper tray removably coupled inside the inner volume. The hopper tray is configured to couple to the camera.

In accordance with one aspect of the disclosure, the inner volume of the housing includes a camera compartment. The camera is removably positioned in the camera compartment.

In accordance with one aspect of the disclosure, the camera compartment includes a panel configured to cover an opening to the camera compartment. The panel is configured to prevent or inhibit dirt, paint, debris, and/or water from entering the camera compartment.

In accordance with one aspect of the disclosure, the camera compartment includes one or more coupling mechanisms configured to removably couple the camera to the housing.

In accordance with one aspect of the disclosure, the camera includes an action camera or an omnidirectional camera.

In accordance with one aspect of the disclosure, a paintball hopper for a paintball gun, includes a housing. The housing includes at least one window. The housing forms an inner volume. The paintball hopper includes display may be positioned on the housing. The paintball hopper includes a user interface. The housing is configured to removably couple to at least one camera removably disposed inside the inner volume so the at least one camera is configured to capture images through the at least one window. The user interface is configured to control one or more functions of the camera and/or the display.

In accordance with one aspect of the disclosure, the at least one window extends from a first side of the housing across a front end of the housing to a second side of the housing.

In accordance with one aspect of the disclosure, the housing includes a first window coupled to a first side of the housing, a second window coupled to a second side of the housing, and a third window coupled to a front end of the housing.

In accordance with one aspect of the disclosure, the display is configured to display the images captured by the at least one camera In accordance with one aspect of the disclosure, the display is pivotably coupled to the housing.

In accordance with one aspect of the disclosure, the user interface includes one or more buttons and/or a touchscreen.

In accordance with one aspect of the disclosure, the housing includes one or more coupling mechanisms on an outer surface of the housing. The one or more coupling mechanisms are configured to couple at least one camera to the outer surface of the housing.

In accordance with one aspect of the disclosure, the paintball hopper includes a power source configured to provide power to the display and/or a feed system of the hopper.

In accordance with one aspect of the disclosure, the power source is configured to provide power to the at least one camera.

In accordance with one aspect of the disclosure, the power source is a first power source, and the paintball hopper includes a second power source configured to provide power to the at least one camera.

In accordance with one aspect of the disclosure, the paintball hopper includes a communication module configured to information to an external device via a wired connection and/or a wireless connection.

In accordance with one aspect of the disclosure, a paintball hopper for a paintball gun includes a housing. The housing includes at least one window removably coupled to the housing. The housing forms an inner volume. The paintball hopper includes a feed system including an actuator. The paintball hopper includes a display pivotably coupled to the housing, a user interface, and at least one power source configured to provide power to the feed system, the display, and/or the camera. The housing is configured to removably couple to at least one camera removably disposed inside the inner volume so the at least one camera is configured to capture images through the at least one window. The at least one user input is configured to control one or more functions of the camera, the actuator, and/or the display.

BRIEF DESCRIPTION OF THE DRAWINGS

Various embodiments are depicted in the accompanying drawings for illustrative purposes and should in no way be interpreted as limiting the scope of the embodiments. Furthermore, various features of different disclosed embodiments can be combined to form additional embodiments, which are part of this disclosure.

DETAILED DESCRIPTION

Although several embodiments, examples, and illustrations are disclosed below, it will be understood by those of ordinary skill in the art that the system, methods, and devices described herein extend beyond the specifically disclosed embodiments, examples, and illustrations and includes other uses of the system, methods, and devices and obvious modifications and equivalents thereof. Embodiments of the disclosure are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the disclosure. In addition, embodiments of the disclosure can include several novel features and no single feature is solely responsible for its desirable attributes or is essential to practicing the system, methods, and devices herein described.

Figure 1A:
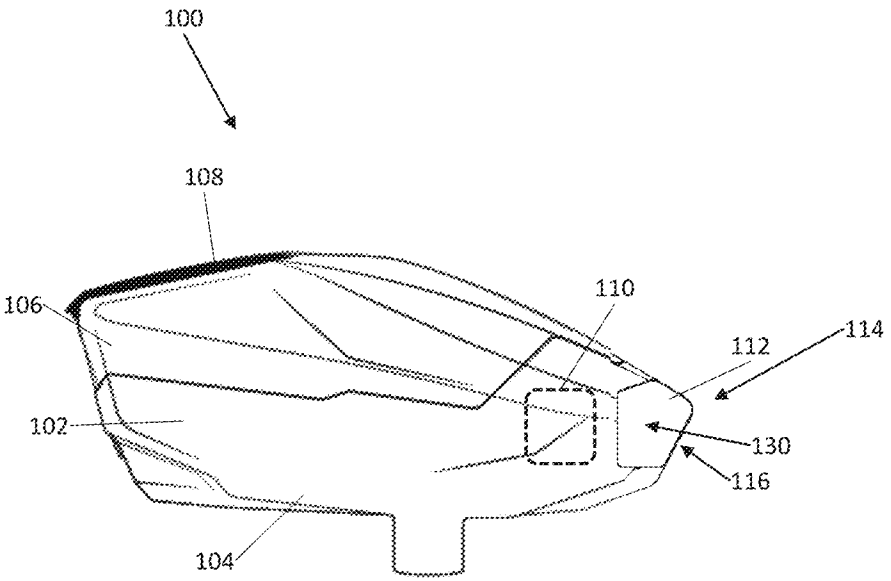
FIG. 1A illustrates a hopper for a paintball gun with a removable camera.
Figure 1B:
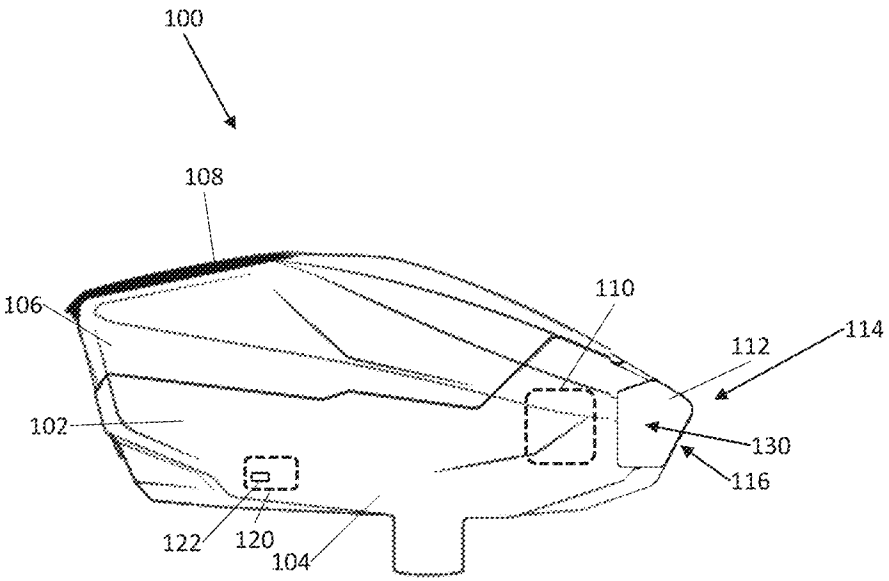
FIG. 1B illustrates the hopper of FIG. 1A with a port and a power source.

FIG. 1A and 1B illustrate a hopper 100 for a paintball gun. The hopper 100 may be removably coupled to a paintball gun or paintball marker. The hopper 100 may supply or transfer paintballs to the paintball gun. The hopper 100 may be a gravity fed hopper and/or an electronic fed hopper. The hopper 100 may include a housing 102. The housing 102 may define an inner volume 130, as shown in FIG. 5, store or house a plurality of paintballs. The housing 102 may be made of a plastic, polypropylene, polyvinyl chloride (PVC), polyethylene, acrylonitrile butadiene styrene (ABS), carbon fiber, nylon, reinforced nylon, metal (e.g., aluminum) and/or any other suitable material.

In some embodiments, the housing 102 may include a body 104 and a cover 106 (e.g., that together define the housing 102). The cover 106 may be pivotably coupled to the body 104 so the cover 106 may be pivoted between a closed position, shown in FIG. 1A, and an open position, shown in FIG. 5A. When the cover 106 in the open position a user may access the inner volume 130 or cavity of the housing 102. In some embodiments, the cover 106 may be removably coupled to the body 104. The cover 106 may be removably coupled to the body 104 via one or more magnets, clamps, clips, latches, hook and loop fasteners, mechanical fasteners, for example one or more screws, and/or any other fastener. In some embodiments, the cover 106 may be press-fit, snap-fit, and/or friction fit to the body 104. In some embodiments, the cover 106 may include an opening to the inner volume 130 of the housing 102. The opening may receive a plurality of paintballs so a user may insert the plurality of paintballs into the inner volume 130 of the housing 102 via the opening. The cover 106 may include a lid 108 pivotably coupled to the cover 106. The lid 108 may pivot between a closed position, as shown in FIG. 1A, and an open position (not shown). When the lid 108 is in the closed position, the lid 108 may cover the opening to prevent or inhibit paintballs from exiting or falling out of the inner volume 130 of the housing 102 via the opening.

In some embodiments, the hopper 100 may include a camera 110. The camera 110 may be removably coupled to the housing 102. In some embodiments, the camera 110 may be inserted into and/or removed from the inner volume 130 or cavity of the housing 102 so the camera 110 is positioned in (i.e., disposed inside) the inner volume 130 of the housing 102. In some embodiments, as described further below with reference to FIG. 6, the camera 110 may be coupled to an outer surface 124 of the housing 102 (e.g., to an outer surface 124 of the cover 106). The camera 110 may include any device (e.g., electronic device) that may capture one or more images, image data, and/or video. In some embodiments, the camera 110 may include an action camera. In some embodiments, the camera 110 may be compact, rugged, and/or waterproof In some embodiments, the camera 110 may include an omnidirectional camera (i.e., a 360-degree camera).

In some embodiments, the camera 110 may be positioned (e.g., in the inner volume 130 or cavity) so a lens of the camera 110 faces a camera opening 116. The camera opening 116 may be an opening or hole in the housing 102 so the camera 110 may capture one or more images, image data, and/or video through the camera opening 116 (i.e., outside of the housing 102) when the camera 110 is positioned in the inner volume 130 of the housing 102. The camera opening 116 may be positioned at a front end 114 of the housing 102, where the front end of the housing 102 faces in the same direction or substantially the same direction as a barrel of the paintball gun when the hopper 100 is coupled to the paintball gun.

In some embodiments, the housing 102 may include a lens or window 112. The window 112 may cover the camera opening 116. The window 112 may protect the camera 110 and/or the lens of the camera 110 from dirt, paint (e.g., paintballs that impact the hopper 100, for example at or proximate the window 112), debris, and/or water. The window 112 may prevent or inhibit dirt, paint, debris, and/or water from entering the inner volume 130 of the housing 102 through the camera opening 116. The window 112 may be transparent and/or semi-transparent so the camera 110 may captures one or more images, image data, and/or video through the window 112. The window 112 may include a UV filter, a skylight filter, a polarizing filter, a neutral density (ND) filter, and/or any other lens filter. The window 112 may be tinted or colored. The window 112 may be made of plastic, glass, acrylic, polycarbonate, and/or any other material.

In some embodiments, the window 112 may form a portion of (i.e., integrated into) the housing 102. In some embodiments, the window 112 may be removably coupled to the housing 102. When the hopper 100 is used on a paintball gun the window 112 may get dirty, scratched, cracked, broken, and/or damaged. Accordingly, the window 112 may advantageously be decoupled or removed from the housing 102 so the window 112 may be cleaned or replaced with a new window 112. The window 112 may be coupled to the housing 102 via one or more magnets, clamps, clips, latches, hook and loop fasteners, mechanical fasteners, for example one or more screws, and/or any other fastener. In some embodiments, the window 112 may be press-fit, snap-fit, and/or friction fit to the housing 102. In some embodiments, a user may need a tool (e.g., a screwdriver, small pry bar, etc.) to couple and/or decouple the window 112 from the housing 102. However, in other embodiments, the user may couple and/or decouple the window 112 from the housing 102 without any tools (e.g., with their hands, for example, where the window 112 couples to the housing 102 with spring-loaded tabs that the user can deflect to decouple and/or couple the window 112 to the housing 102 without tools).

As shown in FIG. 1B, in some embodiments, the hopper 100 may include a power source 120. The power source 120 may be a battery (e.g., rechargeable battery or replaceable battery). The power source 120 may provide power to an electronic feed system of the hopper 100, one or more lights or indicators, and/or any other parts or components of the hopper 100. In some embodiments, the power source 120 may provide power to the camera 110. In some embodiments, the power source 120 may provide power to the camera 110 and one or more parts or components of the hopper 100.

In some embodiments, the hopper 100 may include a port 122. The port 122 may connect the hopper 100 to an external power source (i.e., a wall outlet, an external battery, etc.) via a wired and/or a wireless connection. The port 122 may include a Universal Serial Bus (USB), USB Type A, USB Type B, USB Type C, Mini-USB, Micro-USB, a coaxial power connector (i.e., a barrel connector), and/or any other port. In some embodiments, the port 122 may include one or more induction coils. The power source 120 may receive power from the external power source via the port 122.

In some embodiments, the camera 110 may be connected to the power source 120 and/or the port 122 via a wired or wireless connection. The camera 110 may be powered by the power source 120 and/or the camera 110 may include an internal power source. In some embodiments, the internal power source of the camera 110 may be a battery (e.g., rechargeable battery or replaceable battery). The internal power source of the camera 110 may be charged or recharged (i.e., receive power) from the power source 120 and/or the external power source via the port 122.

Figure 2A:
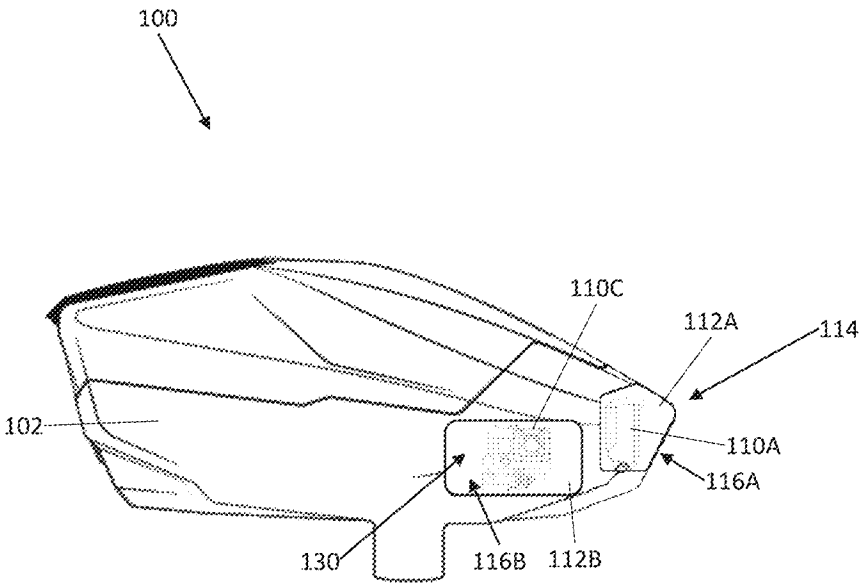
FIG. 2A illustrates a right view of a hopper for a paintball gun with camera openings and windows.
Figure 2B:
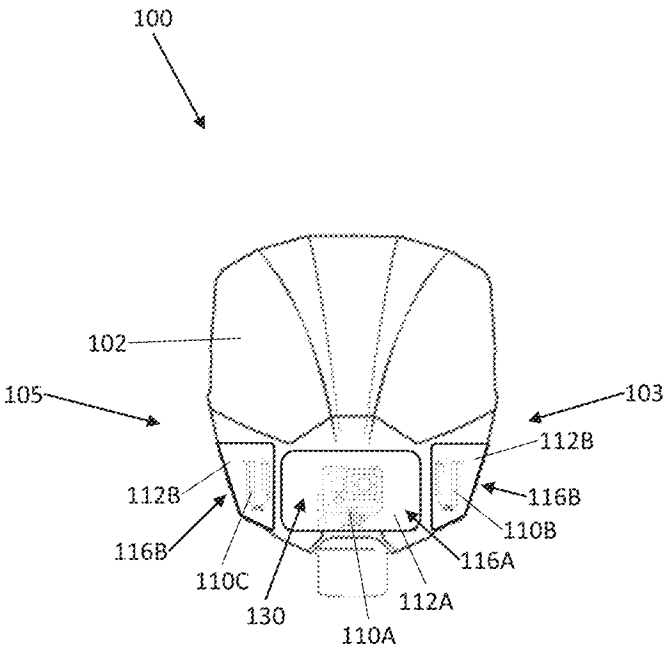
FIG. 2B illustrates a front view of the hopper of FIG. 2A.

FIGS. 2A and 2B illustrate another embodiment of the hopper 100 with a plurality of camera openings 116. The housing 102 of the hopper 100 may include the plurality of camera openings 116. The housing 102 may include a front camera opening 116A and side camera openings 116B. The front camera opening 116A may be positioned at the front end 114 of the housing 102. The side camera openings 116B may be positioned on a first side 103 (i.e., right side) of the housing 102 and a second side 105 (i.e., left side) of the housing 102 opposite the first side 103.

In some embodiments, the housing 102 may include a plurality of (e.g., separate, spaced apart) windows 112. The housing 102 may include a window 112 for each of the plurality of camera openings 116. The housing 102 may include a front window 112A and side windows 112B. The front window 112A may cover the front camera opening 116A. The side windows 112B may cover the side camera openings 116B.

In some embodiments, the camera 110 may rotate (e.g., relative to the housing 102 while it is coupled to the housing 102) such that the camera 110 may capture one or more images, image data, and/or video through the front camera opening 116A and/or the front window 112A, and the side camera openings 116B and/or the side windows 112B. In some embodiments, the camera 110 may include an omni-directional camera (i.e., a 360-degree camera), and the camera 110 may simultaneously capture one or more images, image data, and/or video through the front camera opening 116A and/or the front window 112A, and the side camera openings 116B and/or the side windows 112B.

In some embodiments, the hopper 100 may include a plurality of cameras 110. The hopper 100 may include a first camera 110A, a second camera 110B, and/or a third camera 110C. In some embodiments, the first camera 110A, the second camera 110B, and/or the third camera 110C may be inserted into and/or removed from the inner volume 130 of the housing 102. The first camera 110A, the second camera 110B, and/or the third camera 110C may be removably coupled to the housing 102 inside the inner volume 130. The first camera 110A may be positioned in the inner volume 130 such that the first camera 110A may capture one or more images, image data, and/or video through the front camera opening 116A and/or the front window 112A. The second camera 110B may be positioned in the inner volume 130 such that the second camera 110B may capture one or more images, image data, and/or video through the side camera opening 116B and/or the side window 112B positioned on the first side 103 of the housing 102. The third camera 110C may be positioned in the inner volume 130 such that the third camera 110C may capture one or more images, image data, and/or video through the side camera opening 116B and/or the side window 112B positioned on the second side 105 of the housing 102.

Figure 3A:
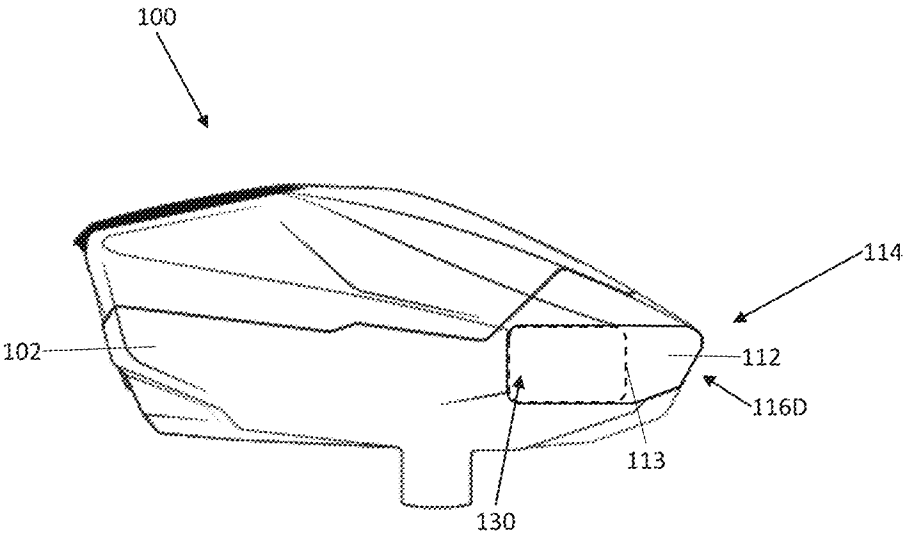
FIG. 3A illustrates a right view of a hopper for a paintball gun with a multi-directional camera opening.
Figure 3B:
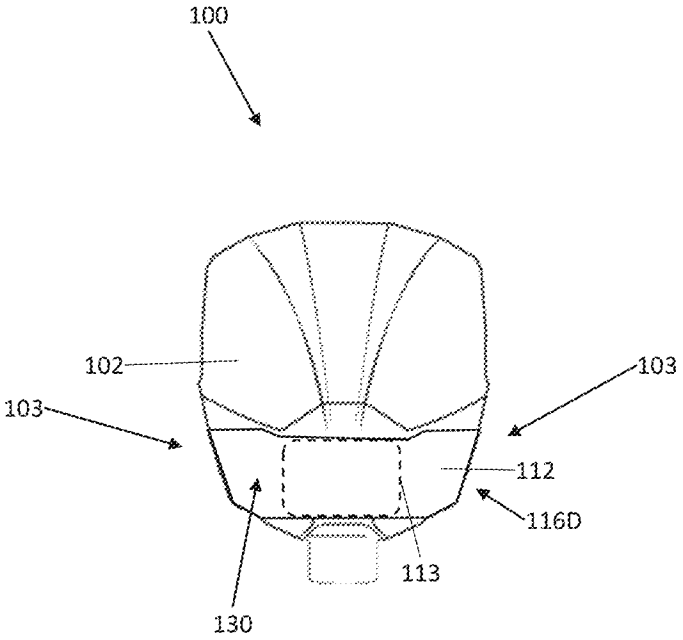
FIG. 3B illustrates a front view of the hopper of FIG. 3A

FIGS. 3A and 3B illustrate another embodiment of the hopper 100 with a multi-directional camera opening 116D.

The multi-directional camera opening 116D may extend from the first side 103 of the housing 102 to the second side 105 of the housing 102 so the multi-directional camera opening 116D extends across the front end 114 of the housing 102. In some embodiments, the window 112 (e.g., a single window) may cover the multi-directional camera opening 116D. In some embodiments, the window 112 may include a plurality of window portions 113 and the plurality of window portions 113 may cover the multi-directional camera opening 116D. For example, a first window portion 113 may cover a first portion of the multi-directional camera opening 116, a second window portion 113 may cover a second portion of the multi-directional camera opening 116, and a third window portion 113 may cover a third portion of the multi-directional camera opening 116. Therefore, in order to clean or replace the window 112 if the window 112 is dirty, scratched, cracked, broken, and/or damaged during use, only the window portion 113 that is dirty, scratched, cracked, broken, and/or damaged may be removed to be cleaned and/or replaced with a new window portion 113.

Figure 4:
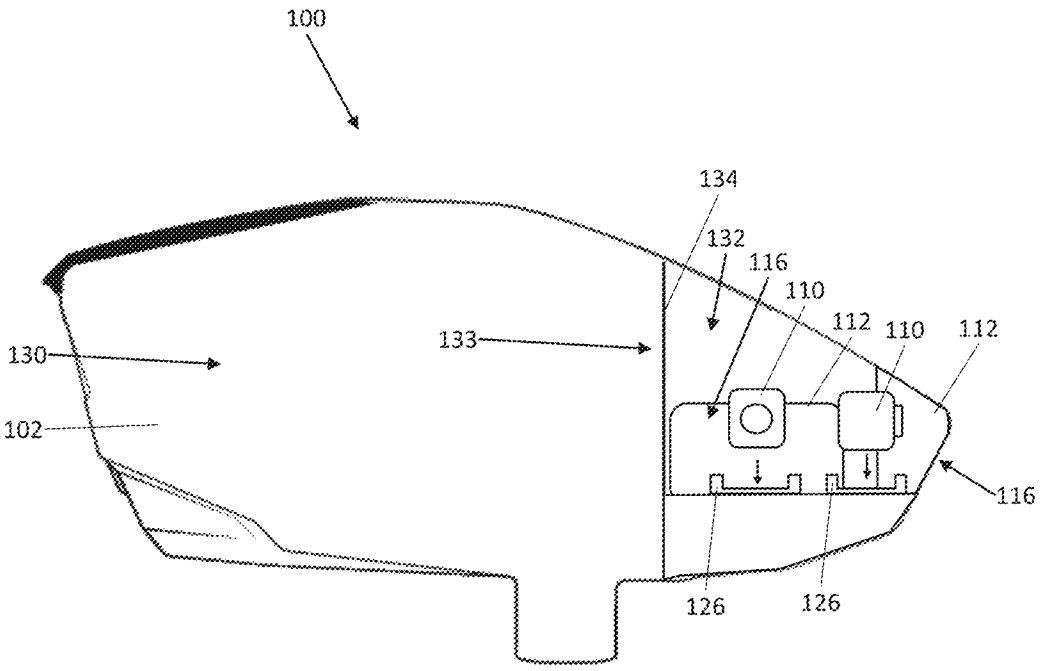
FIG. 4 illustrates a section right view of a hopper for a paintball gun.

FIG. 4 illustrates a cross-section of the hopper 100. As shown in FIG. 4, in some embodiments, the inner volume 130 of the housing 102 may include a camera compartment 132. The camera compartment 132 may include a portion of the inner volume 130 that may contain or house one or more cameras 110. The one or more cameras 110 may be inserted into the camera compartment 132 through a compartment opening 133.

In some embodiments, the hopper 100 may include a coupling mechanism 126. The coupling mechanism 126 may removably couple a camera 110 to the housing 102 so the camera 110 may be positioned in the inner volume 130 and/or the camera compartment 132. In some embodiments, the coupling mechanism 126 may prevent or inhibit vibration of the camera 110 or movement of the camera 110 relative to the housing 102. The coupling mechanism 126 in one example can be a slot. In another example, the coupling mechanism 126 can be a recessed portion in the inner volume 130 or cavity.

In some embodiments, the coupling mechanism 126 may removably couple a mount of the camera 110 to the housing 102. The coupling mechanism 126 may include one or more magnets, clamps, clips, latches, hook and loop fasteners, mechanical fasteners, for example one or more screws, and/or any other fastener. In some embodiments, the mount of the camera 110 may be press-fit, snap-fit, and/or friction fit to the coupling mechanism 126. In some embodiments, the coupling mechanism 126 may be integrated into the housing 102 and the camera 110 may be removably inserted into the coupling mechanism 126. In some embodiments, the camera 110 may be press-fit, snap-fit, and/or friction fit to the coupling mechanism 126.

In some embodiments, the coupling mechanism 126 may be positioned so the camera 110 may capture one or more images, image data, and/or video through a camera opening 116 and/or a window 112. In some embodiments, the coupling mechanism 126 may rotate in order to rotate the camera 110.

In some embodiments, the hopper 100 may include a plurality of coupling mechanisms 126. The plurality of coupling mechanisms 126 may be positioned so a camera 110 inserted into each coupling mechanism 126 may capture one or more images, data, and/or video through camera openings 116 and/or windows 112.

In some embodiments, the hopper 100 may include a panel 134. The panel 134 may cover the compartment opening 133. The panel 134 may prevent or inhibit dirt, paint, debris, and/or water from entering the camera compartment 132 via the compartment opening 133. The panel 134 may be removably coupled to the housing 102 and/or the camera compartment 132. In some embodiments, the panel 134 may be rotatably coupled to the housing 102 and/or the camera compartment 132 so the panel 134 may be rotated between an open position and a closed position. The panel 134 may be coupled to the housing 102 and/or the camera compartment 132 via one or more magnets, clamps, clips, latches, hook and loop fasteners, mechanical fasteners, for example one or more screws, and/or any other fastener. In some embodiments, the panel 134 may be press-fit, snap-fit, and/or friction fit to the housing 102 and/or the camera compartment 132. In some embodiments, a user may need a tool (e.g., screwdriver, small pry bar, etc.) to remove or decouple the panel 134 from the housing 102 and/or the camera compartment 132. However, in some embodiments, the user may remove or decouple the panel 134 from the housing and/or the camera compartment 132 without any tools (e.g., with their hands).

Figure 5A:
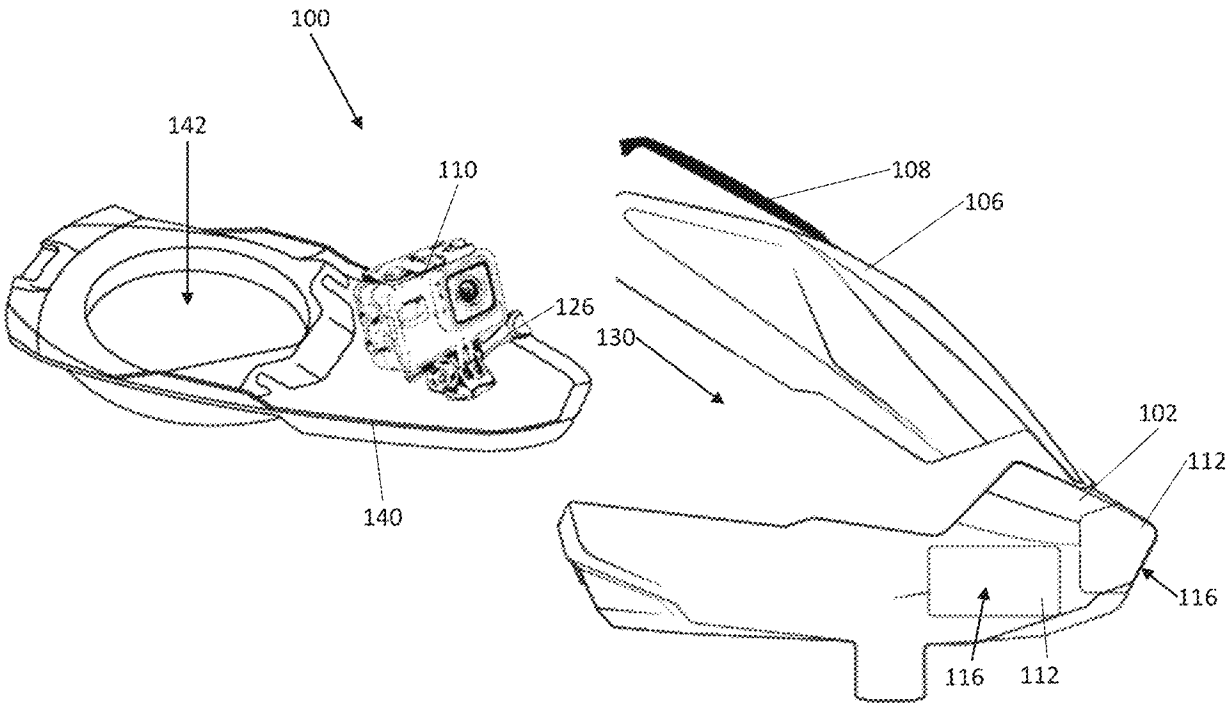
FIG. 5A illustrates a hopper for a paintball gun with a camera tray.
Figure 5B:
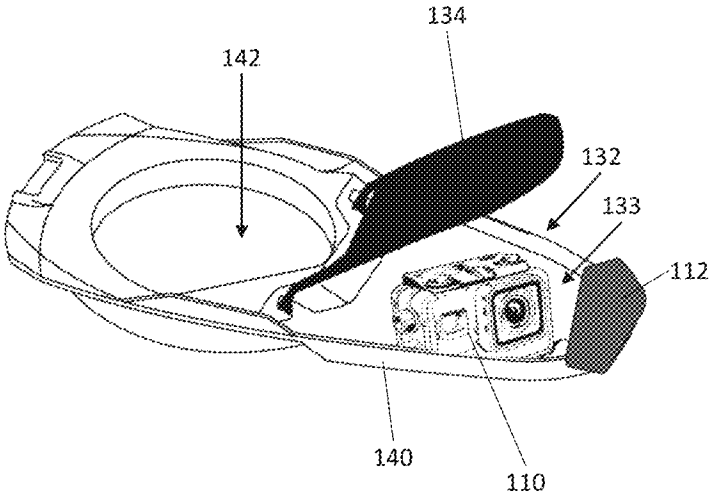
FIG. 5B illustrates another camera tray for the hopper FIG. 5A.

FIGS. 5A and 5B illustrate an embodiment of the hopper 100 with a hopper tray 140. The hopper tray 140 may be removably inserted into the inner volume 130 of the housing 102 when the cover 106 is in the open position. The hopper tray 140 may be include one or more coupling mechanisms 126. The one or more coupling mechanisms 126 may removably couple one or more cameras 110 to the hopper tray 140. Accordingly, a user may removably insert one or more cameras 110 into a plurality of housings 102 without removing or decoupling the one or more cameras 110 from the hopper tray 140.

The one or more coupling mechanisms 126 may be positioned on the hopper tray 140 such that when the hopper tray 140 is inserted into the in the inner volume 130 of the housing 102, the one or more cameras 110 are positioned such that the one or more cameras 110 may capture one or more images, image data, and/or video through a camera opening 116, and/or a window 112.

In some embodiments, the hopper tray 140 may include a paintball hole 142. The paintball hole 142 may be located on the hopper tray 140 so the paintball hole 142 lines up with an electronic feed mechanism and/or a feed path of the hopper 100. Accordingly, paintballs may pass through the paintball hole 142 and the hopper tray 140 may not prevent or inhibit the hopper 100 from supplying or transferring paintballs to the paintball gun.

As shown in FIG. 5B, in some embodiments, the hopper tray 140 may include the camera compartment 132. Accordingly, the camera compartment 132 may be removed from the inner volume 130 of the housing 102 so a user may access the panel 134 of the camera compartment 132 and/or the camera 110 to remove or decouple the panel 134 and/or the camera 110 from the camera compartment 132. In some embodiments, the window 112 (e.g., the front window 112A and/or the side windows 112B) may be coupled to the hopper tray 140. The window 112 may be positioned on the hopper tray 140 so the window 112 covers the camera opening 116 (e.g., the front camera opening 116A, the side camera openings 116B, and/or the multi-directional camera opening 116D) when the hopper tray 140 is inserted into the inner volume 130 of the housing 102.

Figure 6:
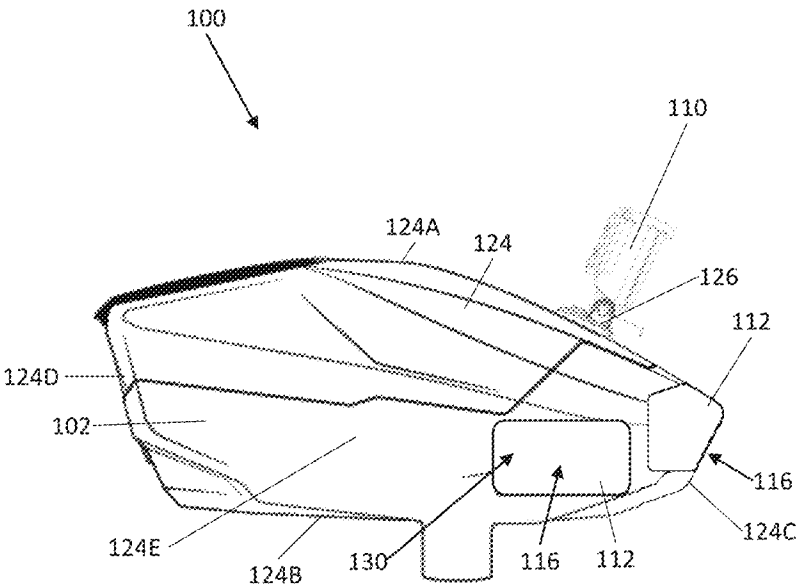
FIG. 6 illustrates a hopper for a paintball gun with a removable camera mounted to an outer surface.

FIG. 6 illustrates another embodiment of the hopper 100 with a housing 102 that may removably couple a camera 110 to an outer surface 124 of the housing 102 (e.g., to the outer surface 124 of the cover of the housing 102). The housing 102 may include a coupling mechanism 126 positioned on the outer surface 124 of the housing 102. The coupling mechanism 126 may be positioned on any portion of the outer surface 124. The coupling mechanism 126 may be positioned on a top surface 124A, a bottom surface 124B, a front surface 124C, a back surface 124D, and/or a side surface 124E.

In some embodiments, the housing 102 may include a plurality of coupling mechanisms 126 positioned on the outer surface 124 of the housing 102 so the housing 102 may removably couple a plurality of cameras 110 to the outer surface 124 of the housing 102. The plurality of coupling mechanisms 126 may be positioned so each of the plurality of cameras 110 face a same direction, or the plurality of coupling mechanisms 126 may be positioned so at least one of the plurality of cameras 110 faces a different direction. The plurality of coupling mechanisms 126 may couple the plurality of cameras 110 to the outer surface 124 of the housing 102 so each of the plurality of cameras 110 may capture one or more images, image data, and/or video in the same direction. In some embodiments, the plurality of coupling mechanisms 126 may couple the plurality of cameras 110 to the outer surface 124 of the housing 102 so at least one of the plurality of cameras 110 may capture one or more images, image data, and/or video in the different direction.

In some embodiments, the housing 102 may include one or more coupling mechanisms 126 positioned in the inner volume 130 of the housing 102 and one or more coupling mechanisms 126 on the outer surface 124 of the housing 102. In some embodiments, the hopper tray 140 may include one or more coupling mechanisms 126 and the housing 102 may include one or more coupling mechanisms 126 on the outer surface 124 of the housing 102. Accordingly, the housing 102 may couple at least one camera 110 to the outer surface 124 of the housing 102 and/or at least one camera 110 in the inner volume 130 of the housing 102.

FIG. 7A-7E illustrates the hopper 100 with a display 150. The display 150 may include an LED display, a mini-LED display, a micro-LED display, an LCD display, a segment code LCD display, a dot matrix display, a twisted nematic display, and/or any other type of display (e.g., electronic display). The display 150 may be positioned on the back surface 124D of the housing 102 (e.g., facing a direction away from the barrel end of the paintball gun or marker). In some embodiments, the display 150 may be positioned on any portion of the outer surface 124 of the housing 102.

The display 150 may communicate with the camera 110 via a wired or wireless connection. In some embodiments, the display 150 may communicate with the camera 110 via Wi-Fi, Bluetooth, Bluetooth® Low Energy, a cellular connection, ultrawideband (UWB), RFID, NFC, wireless local area network (WLAN), and/or any other wireless communication protocol. The display 150 may transmit data to and/or receive data from the camera 110. The display 150 may receive one or more images, image data, video, an indication of a power level of the camera 110, and/or any other information. The display 150 may display the data received from the camera 110. In some embodiments, the display 150 may display the data in real time or substantially real time.

In some embodiments, the display 150 may communicate with a feed system of the hopper 100, and/or any other parts or components of the hopper 100 via a wired or wireless connection. In some embodiments, the display 150 may communicate the feed system of the hopper 100, and/or any other parts or components of the hopper 100 via Wi-Fi, Bluetooth, Bluetooth® Low Energy, a cellular connection, ultrawideband (UWB), RFID, NFC, wireless local area network (WLAN), and/or any other wireless communication protocol. In some embodiments, the display 150 may receive hopper data from the feed system of the hopper 100 and/or any other parts or components of the hopper 100. The hopper data may include a number of paintballs in a housing 102, a feed rate the hopper 100 (i.e., the number of paintballs the hopper 100 supplies to the paintball gun in a particular period of time), an indication of a jam in the feed system, and/or any other information. The display 150 may display the hopper data. In some embodiments, the display 150 may display the hopper data in real time or substantially real time.

In some embodiments, the display 150 may be pivotably coupled to the housing 102. Accordingly, for example, when a user is positioned behind cover (i.e., a barrier, a wall, etc.), the user may position the hopper 100 and/or the paintball gun next to the cover (i.e., not behind the cover) so a camera 110 coupled to the housing 102 may capture one or more images, image data, and/or video of an area in front of the cover, and the user may view the display 150 to see what is in front of the cover.

In some embodiments, the display 150 may be coupled to the housing 102 via a universal joint (U-joint), one or more swivel joints, one or more hinges, or the like. As shown in FIGS. 7B-7E, the display 150 may rotate or pivot from a closed position 150A to an open position 150B. When the display 150 is in the closed position 150A the display 150 may be aligned with the back surface 124D of the housing 102. In some embodiments, as shown in FIG. 7B, when the display 150 is in the open position 150B, the display 150 may be rotated or pivoted upwards (i.e., towards the top of the housing 102) so the display 150 forms an angle 152 with the back surface 124D of the housing 102. In some embodiments, as shown in FIG. 7C, when the display 150 is in the open position 150B, the display 150 may be rotated or pivoted downwards (i.e., towards the bottom of the housing 102) so the display 150 forms the angle 152 with the back surface 124D of the housing 102.

Figure 7A:
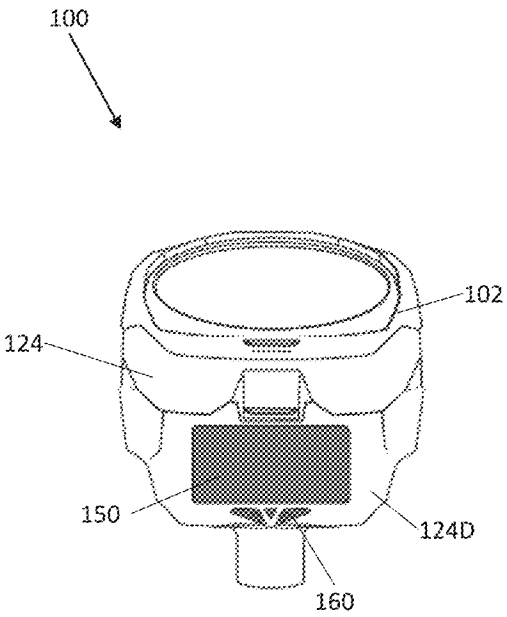
FIG. 7A illustrates a back view of a hopper with a display and a user interface.
Figure 7C:
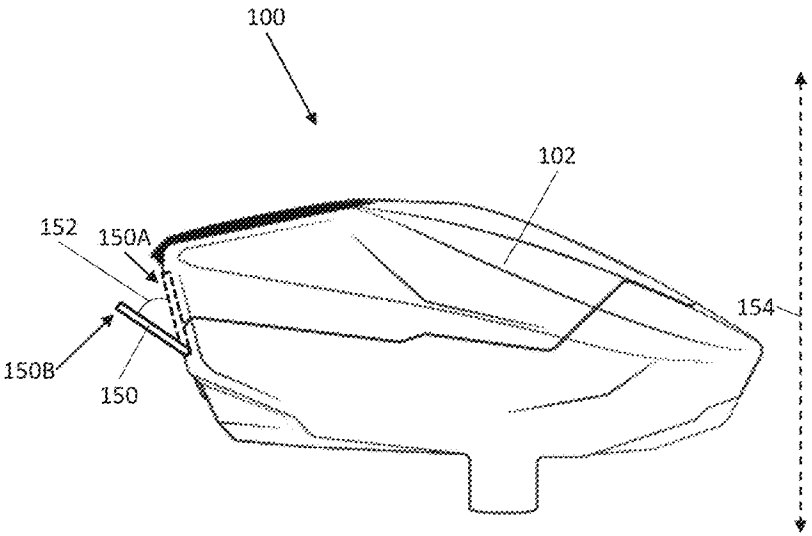
FIG. 7C illustrates the hopper of FIG. 7A with the display rotated downwards.
Figure 7B:
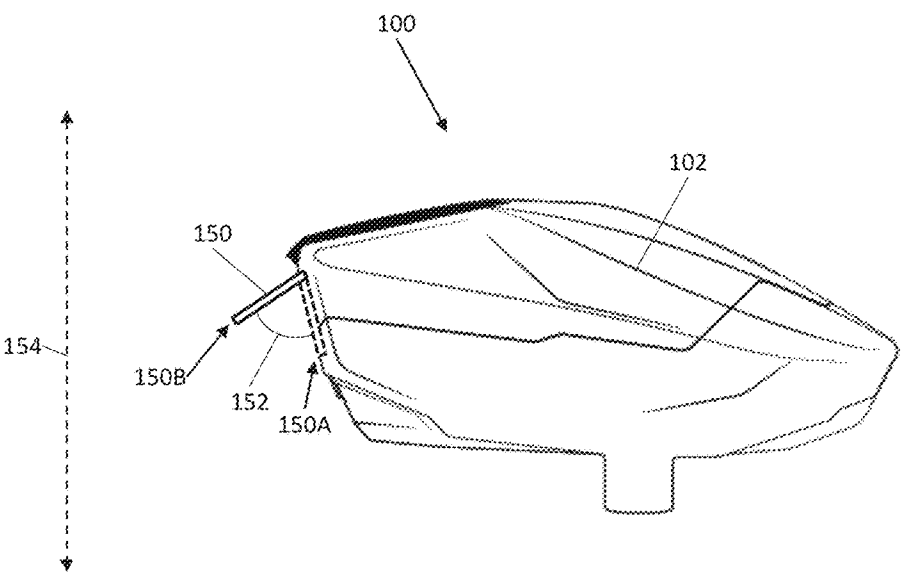
FIG. 7B illustrates the hopper of FIG. 7A with the display rotated upwards.
Figure 7E:
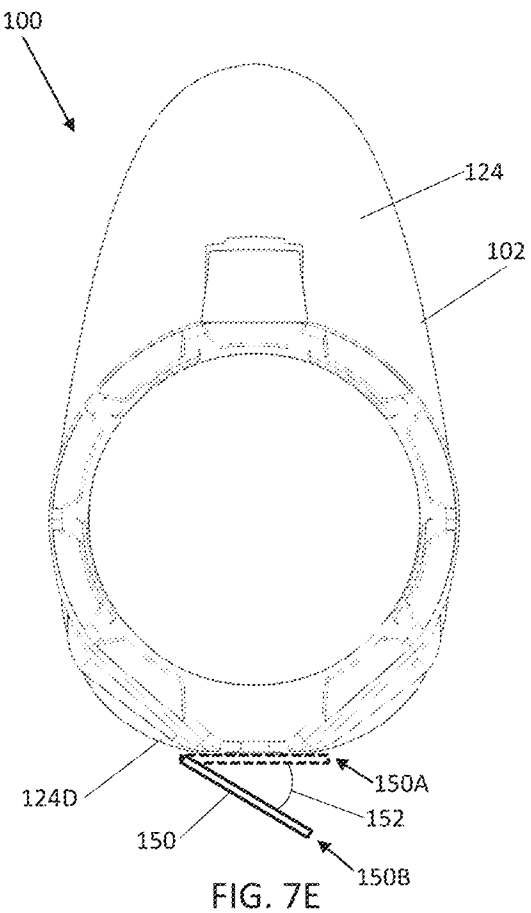
FIG. 7E illustrates a top view the hopper of FIG. 7A with the display rotated in a second direction.
Figure 7D:
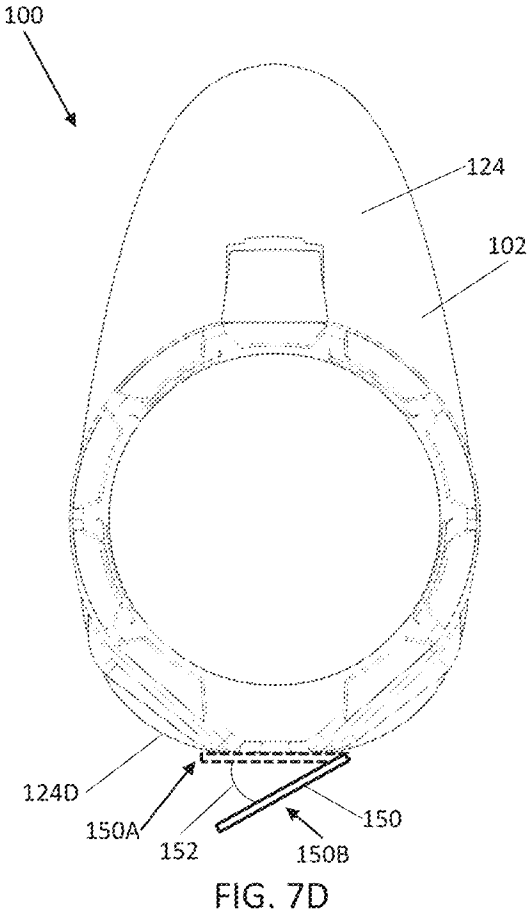
FIG. 7D illustrates a top view the hopper of FIG. 7A with the display rotated in a first direction.

In some embodiments, as shown in FIG. 7D, when the display 150 is in the open position 150B, the display 150 may be rotated or pivoted about a vertical axis 154 (shown in FIGS. 7B and 7C) in a first direction (i.e., towards the second side 105 of the housing 102) so the display 150 forms the angle 152 with the back surface 124D of the housing 102. In some embodiments, as shown in FIG. 7E, when the display 150 is in the open position 150B, the display 150 may be rotated or pivoted about the vertical axis 154 in a second direction opposite the first direction (i.e., towards the first side 103 of the housing 102) so the display 150 forms the angle 152 with the back surface 124D of the housing 102.

As shown in FIG. 7A, the hopper may include a user interface 160. In some embodiments, the user interface 160 may include one or more buttons and the one or more buttons may be coupled to the housing 102. In some embodiments, the user interface 160 may include a touchscreen. In some embodiments, the display 150 may include the user interface 160 and the display 150 may include a touchscreen. The user interface 160 may control one or more functions of the camera 110, the display 150, and/or any parts or components of the hopper 100. The user interface 160 may power on/off the camera 110, the display 150, and/or the feed system of the hopper 100. The user interface 160 may instruct the camera 110 to start and/or stop recording, save and/or delete image data and/or video, transmit image data and/or video to the display 150, and/or transmit image data and/or video to an external device. In some embodiments, the user interface 160 may modify or change one or more settings of the camera 110. For example, the one or more settings of the camera 110 may include a white balance, a color space, an ISO, a shutter speed (i.e., a frame rate), HDR, a noise reduction level, image stabilization, or the like.

In some embodiments, the user interface 160 may instruct the display 150 to play and/or pause image data and/or video, fast forward and/or rewind image data and/or video, and/or scrub through the image data and/or video. In some embodiments, the user interface 160 may modify one or more settings of the display 150. For example, the one or more settings may include a selection of data or information to display on the display 150, brightness, a frame rate, an image data and/or video playback speed, or the like.

In some embodiments, the user interface 160 may modify or change a feed rate of the hopper 100, open and/or close the cover 106 and/or the lid 108, and/or open and/or close the panel 134.

Figure 8A:
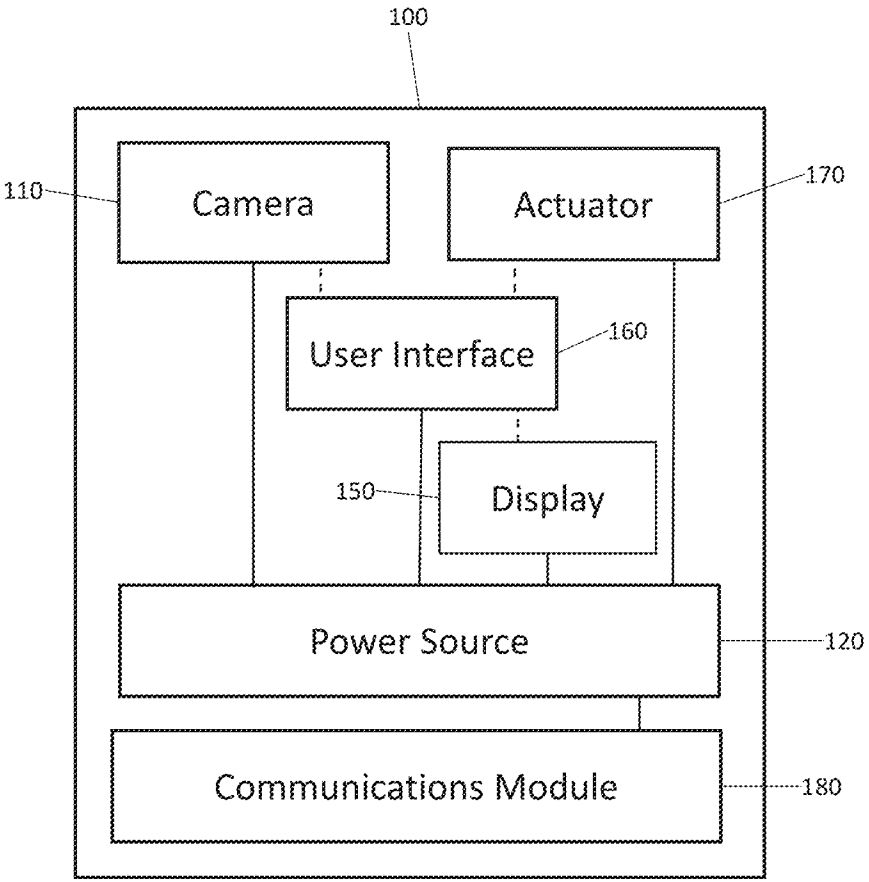
FIG. 8A illustrates a schematic view of components of a hopper for a paintball gun.
Figure 8B:
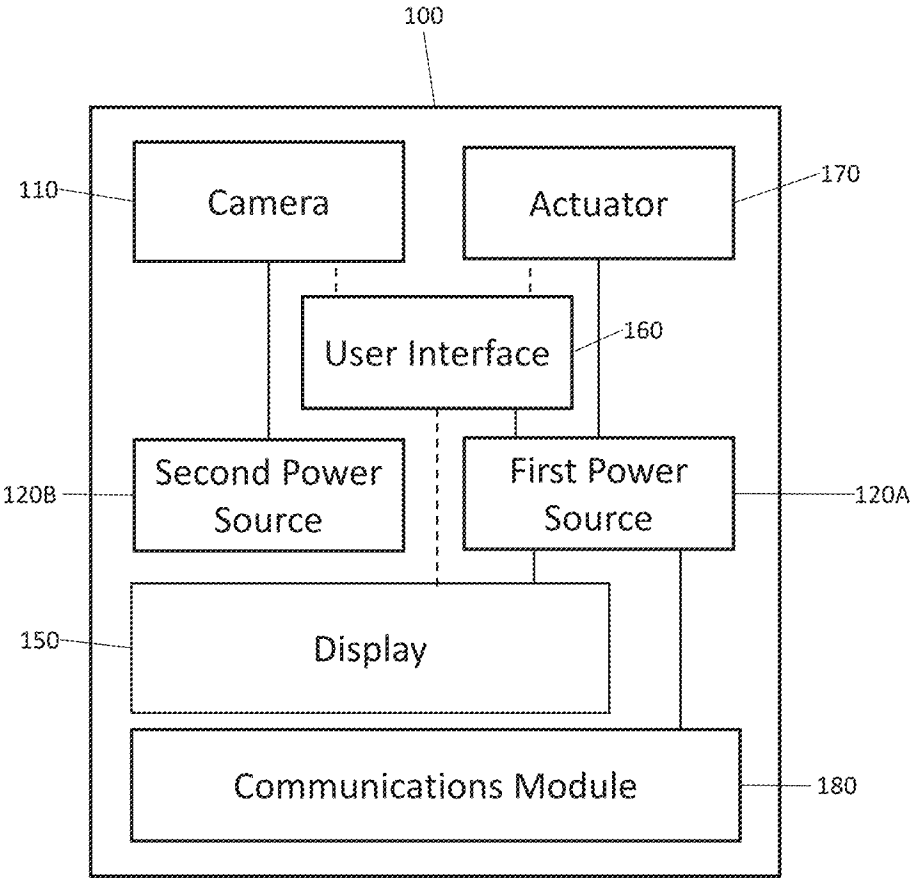
FIG. 8B illustrates a schematic view of components of another hopper for a paintball gun.

FIGS. 8A and 8B illustrate schematics of components of the hopper 100. As shown in FIG. 8A, the hopper 100 may include the camera 110, the power source 120, the display 150, the user interface 160, an actuator 170, and/or a communications module 180. The actuator 170 may control the transfer or supply of paintballs from the inner volume 130 of the housing 102 to the paintball gun via an electronic or gravity feed system of the hopper 100. The communications module 180 may transmit information or data to and/or receive information or data from an external device 190, as described further below with reference to FIG. 9. The power source 120 may provide power to the camera 110, the display 150, the actuator 170, and/or the communications module 180. The user interface 160 may receive one or more user inputs or selections. The user interface 160 may control one or more functions or features of the camera 110, the display 150, the actuator 170, and/or the communications module 180.

As shown in FIG. 8B, in some embodiments, the hopper 100 may include a first power source 120A and a second power source 120B (e.g., that is separate from the first power source 120A, such as a separate battery). The first power source 120A may provide power to the display 150, the actuator 170, and/or the communications module 180. The second power source 120B may provide power to the camera 110. In some embodiments, the second power source 120B may provide power to the camera 110 via a wired or wireless connection. In some embodiments, the second power source 120B may include a power source integrated in the camera 110.

Figure 9:
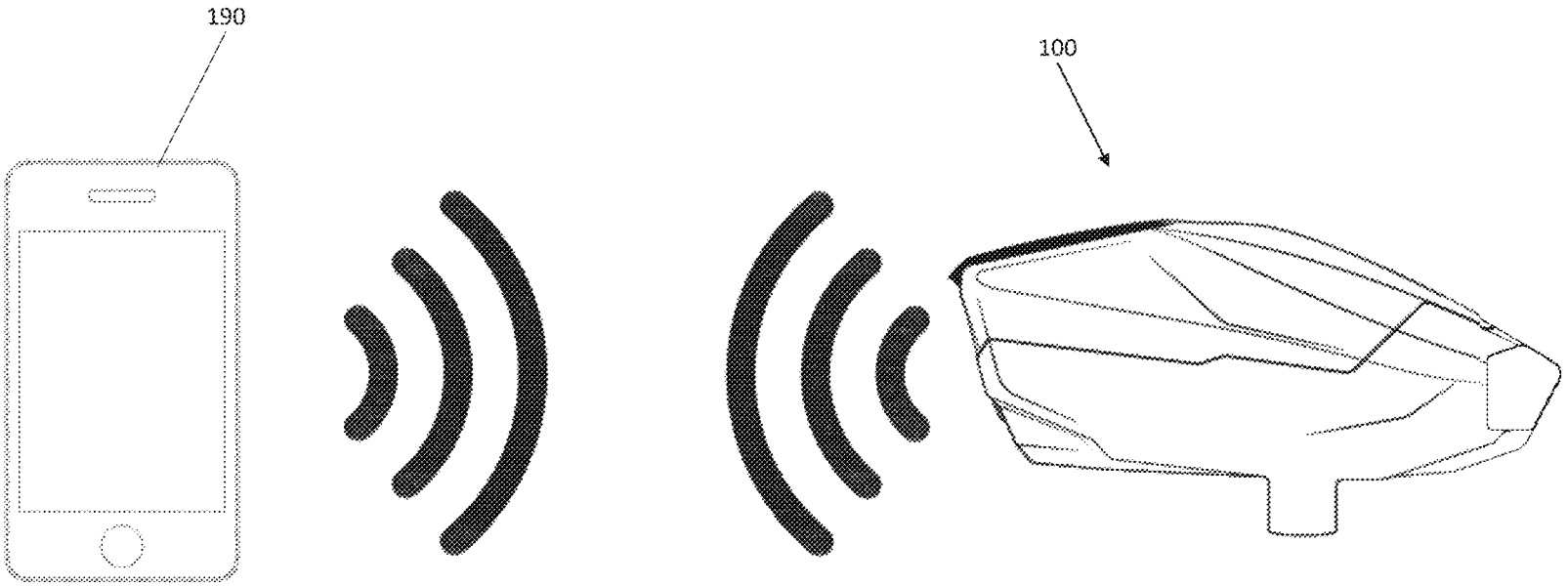
FIG. 9 illustrates a schematic view showing communication between a hopper for a paintball gun and an external device.

FIG. 9 shows the hopper 100 paired with an external device 190. The external device 190 may include any computing device such as a desktop, laptop or tablet computer, personal computer, wearable computer, server, personal digital assistant (PDA), hybrid PDA/mobile phone, mobile phone, set-top box, voice command device, digital media player, a bare metal computer system, a bare machine, and/or any other computing device. The communications module 180 may communicate with the external device 190 to transmit and/or receive any information described herein. The communications module 180 may communicate via a wired and/or wireless connection. In some embodiments, the external device 190 may be connected to the port 122 and the communications module 180 may transmit and/or receive information via the port 122. In some embodiments, the communications module 180 may communicate with the external device 190 via Wi-Fi, Bluetooth, Bluetooth® Low Energy, a cellular connection, ultrawideband (UWB), RFID, NFC, wireless local area network (WLAN), and/or any other wireless communication protocol. In some embodiments, the information or data may be communicated via the cloud.

In some embodiments, the communications module 180 may receive one or more user inputs or selections from the external device 190. The communications module 180 may transmit the one or more user inputs or selections to the user interface 160. In some embodiments, based on the one or more user inputs or selections received from the external device, the communications module 180 may perform one or more functions of the user interface 160 described above.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z,"unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately,""about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A paintball hopper for a paintball gun, the paintball hopper comprising:

a housing comprising a window, wherein the housing forms an inner volume, wherein the housing is configured to removably couple to a camera inside the inner volume so the camera is removably positioned inside the inner volume and configured to capture images through the window.

2. The paintball hopper of claim 1, wherein the window is coupled to a front end of the housing.

3. The paintball hopper of claim 1, wherein the window is removably coupled to the housing.

4. The paintball hopper of claim 1, wherein the hopper further comprises a hopper tray removably coupled inside the inner volume, and wherein the hopper tray is configured to couple to the camera.

5. The paintball hopper of claim 1, wherein the inner volume of the housing comprises a camera compartment, and wherein the camera is removably positioned in the camera compartment.

6. The paintball hopper of claim 5, wherein the camera compartment comprises a panel configured to cover an opening to the camera compartment, and wherein the panel is configured to prevent or inhibit dirt, paint, debris, and/or water from entering the camera compartment.

7. The paintball hopper of claim 5, wherein the camera compartment comprises one or more coupling mechanisms configured to removably couple the camera to the housing.

8. The paintball hopper of claim 1, wherein the camera comprises an action camera or an omnidirectional camera.

9. A paintball hopper for a paintball gun, the hopper comprising:

a housing comprising at least one window, wherein the housing forms an inner volume;

a display positioned on the housing;

a user interface, and wherein the housing is configured to removably couple to at least one camera removably disposed inside the inner volume so the at least one camera is configured to capture images through the at least one window, wherein the user interface is configured to control one or more functions of the camera and/or the display.

10. The paintball hopper of claim 9, wherein the at least one window extends from a first side of the housing across a front end of the housing to a second side of the housing.

11. The paintball hopper of claim 9, wherein the housing comprises a first window coupled to a first side of the housing, a second window coupled to a second side of the housing, and a third window coupled to a front end of the housing.

12. The paintball hopper of claim 9, wherein the display is configured to display the images captured by the at least one camera.

13. The paintball hopper of claim 9, wherein the display is pivotably coupled to the housing.

14. The paintball hopper of claim 9, wherein the user interface comprises one or more buttons and/or a touch-screen.

15. The paintball hopper of claim 9, wherein the housing further comprises one or more coupling mechanisms on an outer surface of the housing, and wherein the one or more coupling mechanisms are configured to couple at least one camera to the outer surface of the housing.

16. The paintball hopper of claim 9, further comprising a power source configured to provide power to the display and/or a feed system of the hopper.

17. The paintball hopper of claim 16, wherein the power source is configured to provide power to the at least one camera.

18. The paintball hopper of claim 16, wherein the power source is a first power source, and wherein the paintball hopper further comprises a second power source configured to provide power to the at least one camera.

19. The paintball hopper of claim 9, further comprising a communication module configured to information to an external device via a wired connection and/or a wireless connection.

20. A paintball hopper for a paintball gun, the hopper comprising:

a housing comprising at least one window removably coupled to the housing, wherein the housing forms an inner volume;

a feed system comprising an actuator;

a display pivotably coupled to the housing;

a user interface;

at least one power source configured to provide power to the feed system, the display, and/or at least one camera, and wherein the housing is configured to removably couple to the at least one camera removably disposed inside the inner volume so the at least one camera is configured to capture images through the at least one window, wherein the user interface is configured to control one or more functions of the at least camera, the actuator, and/or the display.

* * * * *